United States Patent [19]

Talir

[11] Patent Number: 4,636,599

[45] Date of Patent: Jan. 13, 1987

[54] HIGH-VOLTAGE SWITCH

[75] Inventors: Walter Bischofberger, Niederweningen; Heinz Eichholzer, Thalwil; Werner Graber, Ennetbaden; Jiri Talir, Baden, all of Switzerland

[73] Assignee: BBC Brown, Boveri & Company, Ltd., Switzerland

[21] Appl. No.: 696,266

[22] Filed: Jan. 30, 1985

[30] Foreign Application Priority Data

Feb. 23, 1984 [CH] Switzerland ..... 884/84

[51] Int. Cl.[4] ..... H01H 33/16

[52] U.S. Cl. ..... 200/144 AP; 200/145; 200/146 R

[58] Field of Search ..... 200/144 AP, 145, 146 R

[56] References Cited

U.S. PATENT DOCUMENTS

| | | | |
|---|---|---|---|
| 2,894,100 | 7/1959 | Hoffman | 200/145 |
| 3,538,278 | 11/1970 | Rathbun | 200/144 AP |
| 4,488,021 | 12/1984 | Yoshizumi | 200/146 R |
| 4,520,246 | 5/1985 | Yoshi et al. | 200/146 R |

FOREIGN PATENT DOCUMENTS

| | | | |
|---|---|---|---|
| 1064134 | 8/1959 | Fed. Rep. of Germany | 200/145 |
| 192697 | 11/1964 | Sweden | 200/145 |
| 360712 | 4/1962 | Switzerland | 200/145 |

*Primary Examiner*—Robert S. Macon

*Attorney, Agent, or Firm*—Ostrolenk, Faber, Gerb & Soffen

[57] ABSTRACT

Two series-connected main switching contacts (1*a*, 1*b*) mounted on a housing (7) are actuated, in conjunction with an auxiliary switching unit (4) for switching a closing or starting resistance (3), by a drive (5) via a switching drive mechanism (6). To obviate the need for a second auxiliary switching unit and to achieve other cost reductions, the closing resistance (3) and the auxiliary switching unit (4) are connected in a parallel circuit and in series between the main switching contacts (1*a*, 1*b*). The foregoing components are accommodated in the housing (7). During a switching-on process, the auxiliary switching unit (4) closes after the main switching contacts close (1*a*, 1*b*) and the closing resistance (3) is bypassed. During the switching-off process, the auxiliary switching unit opens after the main switching contacts (1*a*, 1*b*). A hollow cylinder (21) which carries a moving contact member (9) of the auxiliary switching unit (4), is displaceable to a limited extent with respect to a guide rod (16) of the switching drive mechanism. The hollow cylinder is pushed by a plunger (17) on the guide rod (16) and by a ramming piston (18) into an on position at which the moving contact member (9) locks into a fixed contact member (10). During the switching-off process, the locking mechanism, which can normally withstand a counter force exerted by a tension spring (27), is released by the plunger (17). In another embodiment, the moving contact member of the auxiliary switching unit is constructed as a blade contact which is pivoted on the metal housing.

9 Claims, 17 Drawing Figures

HIGH-VOLTAGE SWITCH

BACKGROUND OF THE INVENTION

The invention relates to a high-voltage switch which has several switching units. Such switches are used for switching a high voltage onto transmission lines of great lengths.

A high-voltage switch according of the type to which the present invention relates is known from EP 0 050 826 A 20, particularly FIG. 3 thereof, in which a series circuit consisting of a closing resistance and an auxiliary switching unit connected in parallel with each main switching point.

Because two auxiliary switching units are needed, the construction of such switches is expensive.

The present invention has the objective of constructionally simplifying and lowering the cost of switches of this type.

SUMMARY OF THE INVENTION

The advantages achieved by the invention can be seen especially in the fact that only a single auxiliary switching unit is provided. In addition, the closing or switch-on resistance replaces the two closing resistances of the known generic switch. The single closing resistance can be accommodated in a housing, which can be constructed as a cost-effective metal housing, in such a manner that the insulating clearance required between the two terminals of the switch is located inside the housing. This eliminates the necessity for producing external insulating clearances and the more elaborate housings of insulating material required with the known generic switch and containing a closing resistance and an auxiliary switching path in each case can be saved. This results in a considerable cost reduction.

In the off condition, when the main switching points are open, the auxiliary switching point is completely free of voltage. Accordingly, its switching state is then irrelevant and does not need to be checked. The auxiliary switching point is loaded with voltage only briefly during the switching-on process. The loading on the insulation is correspondingly low.

It would be conceivable to save one auxiliary switching point by placing a single series circuit consisting of a closing resistance and an auxiliary switching point in parallel with the series circuit of the main switching points.

Such a solution appears to be unsuitable, however, since not only, instead of saving two housings of insulating material, one of these would have to be replaced by one of approximately twice the length, but the total voltage would be constantly applied to the auxiliary switching point, even in the off condition, which would create considerable insulation problems.

BRIEF DESCRIPTION OF THE DRAWINGS

Below, the invention is explained in greater detail by reference to the drawings in which:

FIG. 1*a* shows the off state, FIG. 1*b* shows the state occurring during the switching-on process, with closed main switching points and open auxiliary switching point, that is to say with the starting resistance switched in, FIG. 1*c* shows the on state and FIG. 1*d* shows the state, occurring during the switching-off process, with open main switching points and closed auxiliary switching point;

FIGS. 2*a* and 2*b* show vertical sections through parts of a high-voltage switch according to the invention in accordance with the first constructional design, of which FIG. 2*a* shows a section through a central housing comprising closing resistance, auxiliary switching point and switching drive mechanism, on the left in the off state and on the right an intermediate state, occurring during the switching-on process, shortly before the main switching points are closed, and FIG. 2*b* shows the auxiliary switching point and switching drive mechanism, on the left in the on state and on the right in a state, occurring during the switching-off process, with the main switching points already open;

FIG. 8 shows, in a basic circuit diagram, the switch according to the invention in accordance with the second constructional design, in the state occurring during the switching-on process, with closed main switching points and open auxiliary switching point, that is to say with the starting resistance switched in, FIGS. 9*a, b* show vertical sections through switching drive mechanisms and auxiliary switching point of a high-voltage switch according to the invention in accordance with the third constructional design, of which

DETAILED DESCRIPTION

Figure 1A:
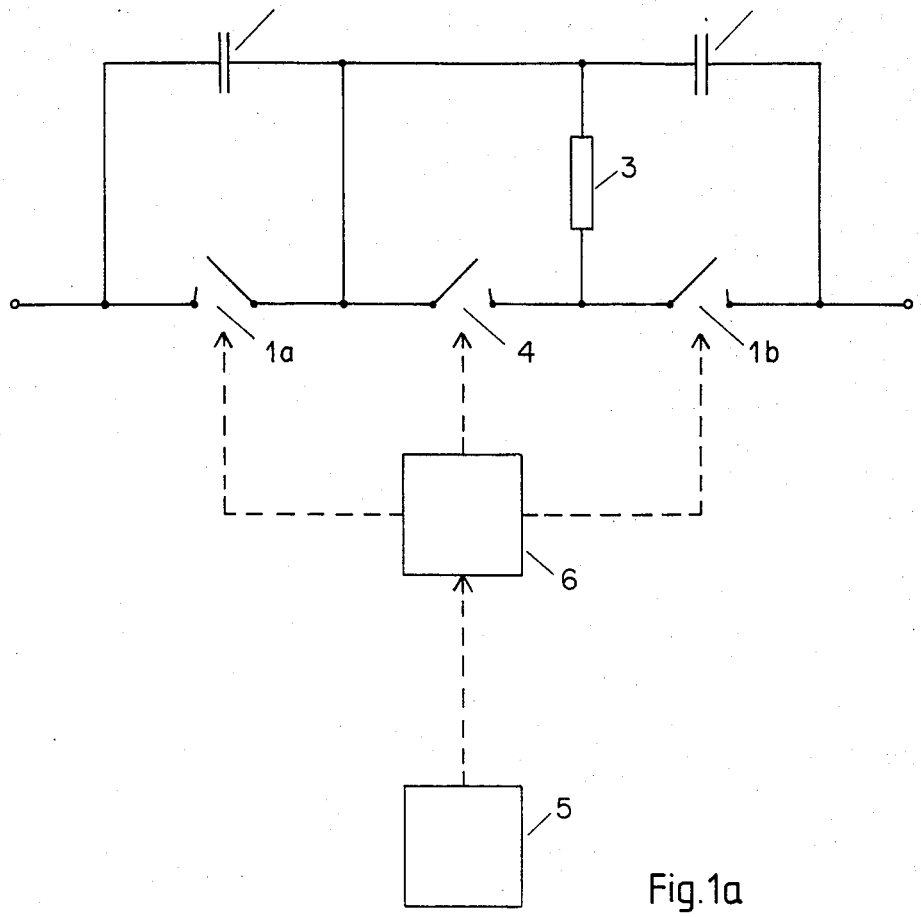
FIGS. 1*a*–1*d* show basic circuit diagrams of high-voltage switches according to the invention in accordance with a first and a third constructional design in electric switching states occurring during the switching-on and switching-off process more particularly

FIG. 1*a* shows a high-voltage switch according to the invention in accordance with a first and a third constructional design and in an off state. The switch contains in its fundamental configuration two main switching points 1*a, b,* control capacitors 2*a* and 2*b* a closing resistance 3 and an auxiliary switching unit 4. The main switching points 1*a, b* and the auxiliary switching point 4 are actuated by a common drive 5 via a switching drive mechanism 6.

According to the invention, the closing resistance and the auxiliary switching unit 4 are located in parallel with each other between the first main switching point 1*a* and the second main switching point 1*b*. Switching points and switching drive mechanisms are constructed in such a manner that, on switch-on, the auxiliary switching point 4 closes after the main switching points 1*a, b,* during which process, therefore, the switch passes through the electric state shown in FIG. 1*b* in which the two closed main switching points 1*a,* 1*b* are connected with each other via the closing resistance 3. After the auxiliary switching point 4 has closed, the on state shown in FIG. 1*c* is reached, in which the closing resistance 3 is bypassed by the auxiliary switching unit 4.

During a switching-off process, the auxiliary switching unit 4 opens after main switching points 1*a, b.* When the main switching points are opening, arcs form between their contacts. The control capacitors 2*a, b,* which are then each connected in parallel with the respective main switching point 1*a* or 1*b,* assure uniform distribution of the voltage to the two main switching units or points. After the arcs have quenched, the switch has reached the electric state shown in FIG. 1*d* in which the auxiliary switching unit 4 is closed but does not carry any more current. It can thus be opened without problem. After the auxiliary switching unit 4 has opened, the switch is again in the off state shown in FIG. 1*a.*

Figure 2A:
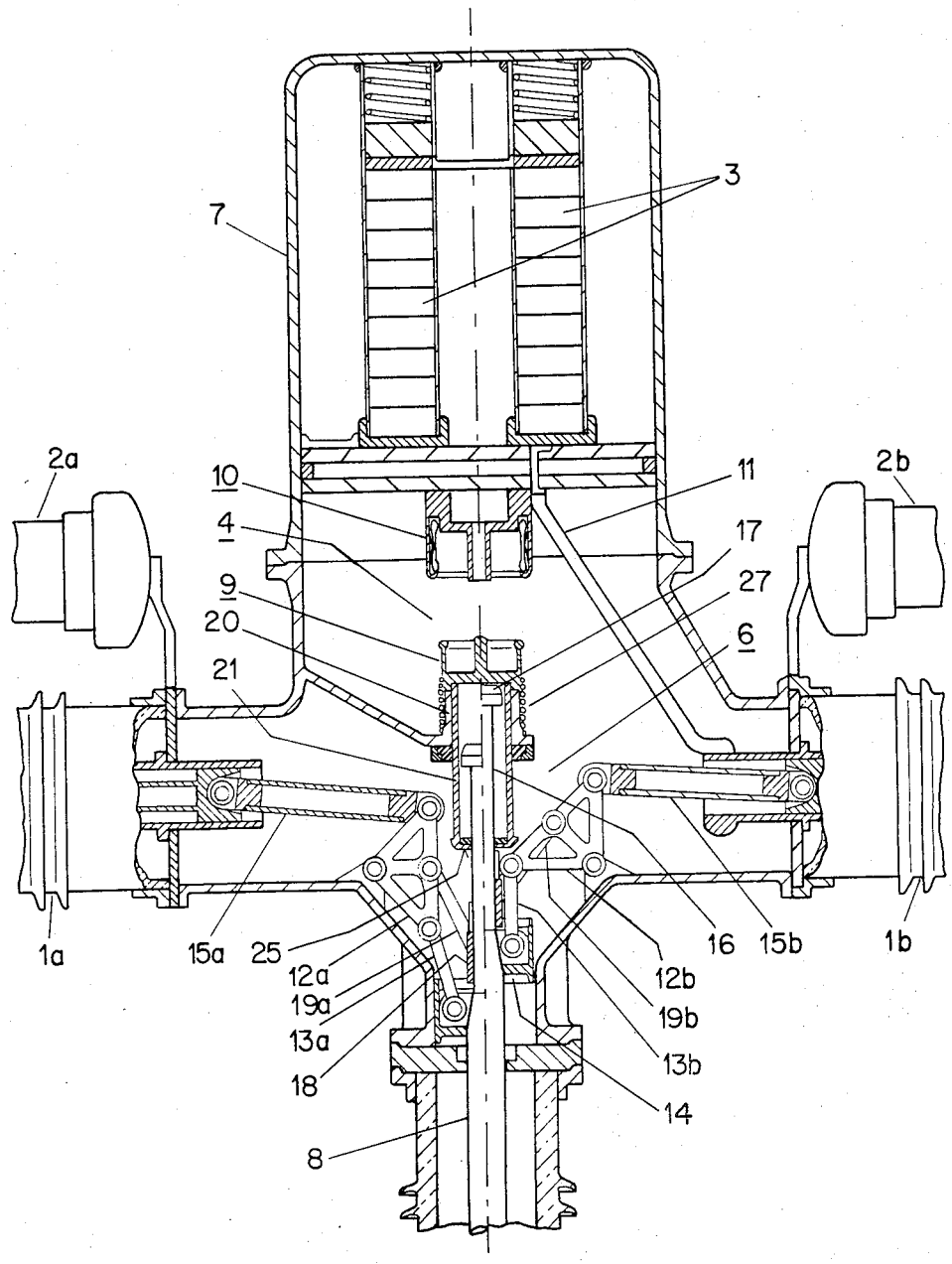

FIGS. 2*a,* 2*b,* 3, 4, 5 show a high-voltage switch according to the invention in accordance with a first embodiment. The two series-connected main switching points 1*a, b* are constructed as high-voltage power switches comprising porcelain housings such as are known, for example, from Brown Boveri Mitteilungen 3/4 (1981), page 121, and the control capacitors 2*a, b* also have porcelain housings and are arranged in parallel with the main switching points 1*a, b.* Being located opposite each other, the housings of the main switching points 1*a, b* adjoin an $SF_6$-filled housing 7 which consists of metal, preferably cast aluminium, and which contains the switching drive mechanism 6 which is joined via an operating rod 8 of insulating material to drive 5, not shown in great detail in the drawings. Closing resistance 3 is divided into two series-connected columns of resistance elements. The moving contact member of the first main switching point 1*a* and the moving contact member 9 of the auxiliary switching unit 4 are electrically conductively connected to the housing 7.

According to the invention, closing resistance 3 and the auxiliary switching unit 4 are arranged in the housing 7 which is also used to establish the electrically conductive connection between the first main switching point 1*a* and closing resistance 3. The terminal of closing resistance 3, opposite to that joined to the housing 7, is electrically conductively connected, on the one hand, to the fixed contact member 10 of the auxiliary switching unit 4 and, on the other hand, via a connecting conductor 11 to the moving contact member of the second main switching point 1*b* which is insulated with respect to the housing 7, that is to say connected only indirectly to this housing via closing resistance 3 and the auxiliary switching unit 4 if the latter is closed.

In its fundamental configuration, the switching drive mechanism 6 contains two guide levers 12*a, b* which are pivoted opposite to each other on the side of the operating rod 8 at the housing 7. They are non-positively joined, on the one hand, via lifting bars 13*a, b* to a piston 14 which is attached to the switching rod 8 and, on the other hand, via lifting tubes 15*a, b,* the lifting tube 15*b* essentially consisting of insulating material, in each case to the moving contact member of the respective main switching point 1*a* and 1*b.*

According to the invention, the switching drive mechanism 6 is provided with a guide part, which is constructed as a guide rod 16 having at its end a plunger 17, is rigidly joined to operating rod 8 and, in extension of the latter, projects into the interior of the housing 7 and which participates in the actuation of the auxiliary switching unit 4. In addition, the switching drive mechanism 6 is provided with a shell-shaped ramming piston 18 which is carried on the guide rod 16 and which is non-positively joined via carrier bars 19*a, b* to the guide levers 12*a, b.*

The moving contact member 9 of the auxiliary switching point 4 is attached to a link which is constructed as a hollow cylinder 21 inverted over the guide rod 16 and carried in a guide ring 20 which is rigidly joined to the housing 7. To a limited extent, the hollow cylinder 21 and the guide rod 16 can be displaced with respect to each other in the direction of the switching movements, the stop, which limits the displaceability of the guide rod 16 with respect to the hollow cylinder 21 in the direction of switching off, being formed by the back of the plunger 17 and a withdrawing area 22, which faces the inside of the hollow cylinder 21, on a ring 23 which is attached to the off-side end of the latter. On the on-side, the inside of the hollow cylinder 21 is delimited by a stop area 24. The outside of the ring 23 is constructed as ramming area 25 which works in conjunction with the ramming piston 18. On its off side, the guide ring 20 is provided with a cushioned stop 26 which works in conjunction with a part, projecting radially outward, of the ring 23. The opposite end of a tension spring 27, which is anchored at the guide ring 20, is attached to the moving contact member 9 of the auxiliary switching unit 4.

The fixed contact member 10 of the auxiliary switching unit 4 is provided with a rated-current contact having contact fingers 28 in a crown-like arrangement which, in the on position, are pressed by means of spring elements 29 against an annular moving rated-current contact 30 which is contacted by them on its outside. The contact fingers 28 have cams 31 which, together with a peripheral bead 32 at the moving rated-current contact 30, behind which it is engaged by them, form a detent which is effective in the on position between the fixed contact member 10 and the moving contact member 9 of the auxiliary switching unit 4, in such a manner that the locking withstands the force exerted by the tension spring 27. A fixed arcing contact 33, which is of tubular construction and arranged centrally and which operates in conjunction with a moving arcing contact 34 of pin-shaped construction and is coaxially surrounded at a distance by the moving rated-current contact 30, is coaxially surrounded at a distance by the contact fingers 28.

In the text which follows, the operation of the switch according to the invention in accordance with the first embodiment is explained with reference of FIGS. 1*a–d,* 2*a, b,* 3–6.

Figure 6:
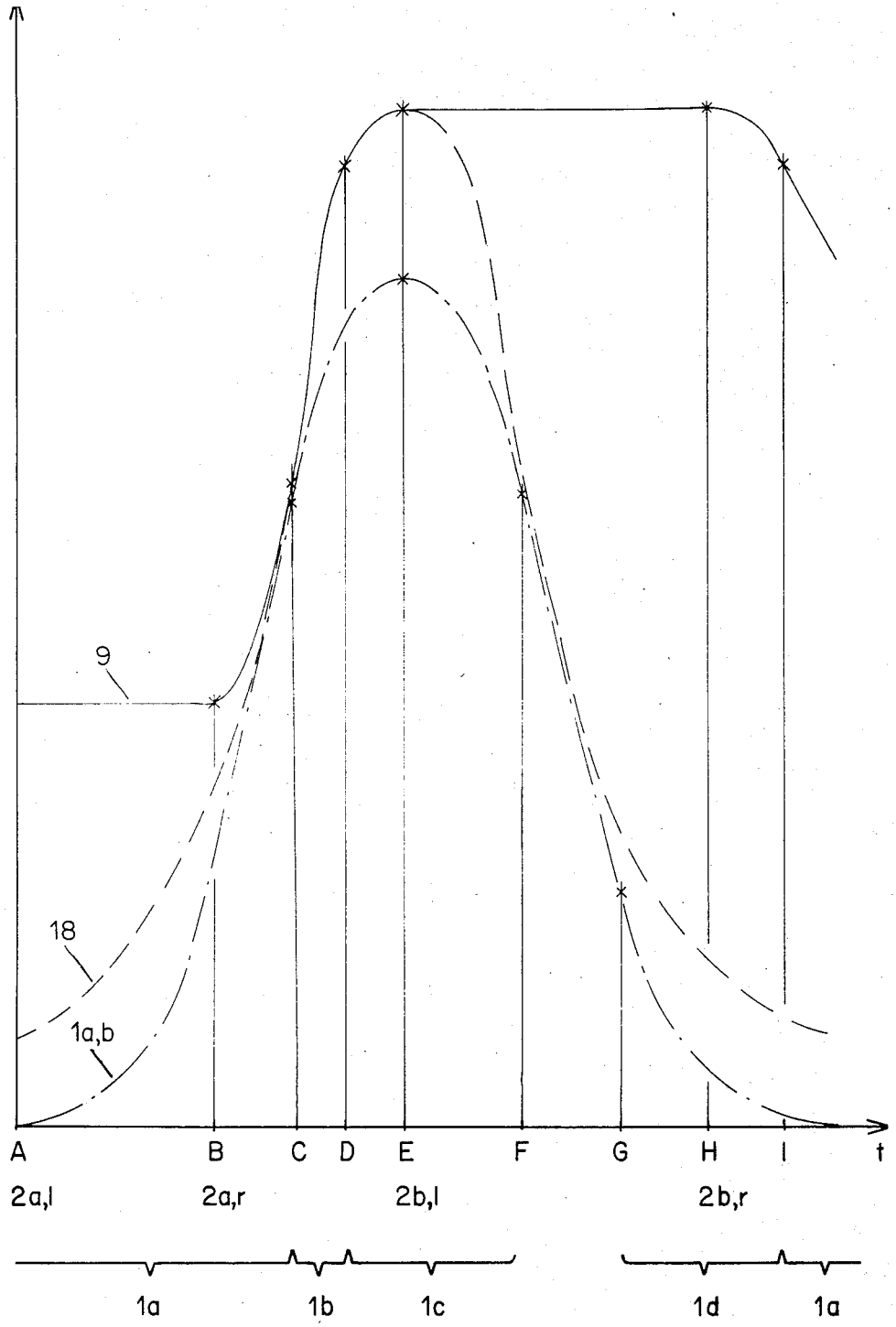
FIG. 6 shows diagrammatically the variation, with time, of the strokes of parts of the switch according to the invention in accordance with the first constructional design during a switching-on process and a switching-off process.

In FIG. 6, time is plotted on the abscissa, and the strokes of the moving contact members of the main switching paths 1*a, b* (dot-dashed line) of the ramming piston 18 (dashed line) and of the moving contact member 9 of the auxiliary switching unit 4 (continuous line) are plotted on the ordinate. The designations 2*a,* l, 2*a,* r, 2*b,* l, 2*b,* r below the abscissa refer to the left-hand half and right-hand half of FIGS. 2*a, b* which in each case represent the state of the switch reached at the given time. The brackets below the abscissa, carrying the designations 1*a*–1*d,* refer to the respective electric state of the switch, as shown in FIGS. 1*a–d.*

It is assumed that the switch is in an off state at a time A. This is shown in FIG. 2*a* in the left-hand side, in which state the switch is in the electric state shown in FIG. 1*a*—the main switching points 1*a, b* and the auxiliary switching point 4 are open—the switch is brought into a first intermediate state, reached at a time B and shown in FIG. 2*a,* right-hand half, by an upward movement of operating rod 8, which rotates the guide levers 12*a, b* and thus initiates the closing movement of the moving contact members of the main switching points or units 1*a, b* and causes the ramming piston 18 to be pulled up by the carrier bars 19*a, b* and the plunger 17 to be pushed up, in which intermediate state the main switching points 1*a, b* are not quite closed, the moving contact member 9 of the auxiliary switching point still rests, held by the tension spring 27, on the guide ring 20 and the stop area 24 is just contacted by the plunger 17, whilst the ramming piston 18 has not quite reached the ramming area 25.

Shortly thereafter, at a time C, the switch reaches a state in which the main switching points 1*a, b* just close and the ramming piston 18, which, pulled by the carrier bars 19*a, b* which, in the off position, had assumed an acute angle with respect to operating rod 8 which, however, has become more open in the course of the switching-on movement so that the ramming piston 18 is now pulled up a relatively long way along the guide rod 16 even with a small stroke of the switching rod 8, comes into contact with the ramming area 25. The switch assumes the electric state shown in FIG. 1*b*—the main switching points 1*a, b* are closed and the auxiliary switching unit 4 is open—and the current flows from the moving contact member of the first main switching point 1*a* via the metal housing 7 through starting resistance 3 and the connecting conductor 11 to the moving contact member of the second main switching point 1*b.*

Figure 1C:
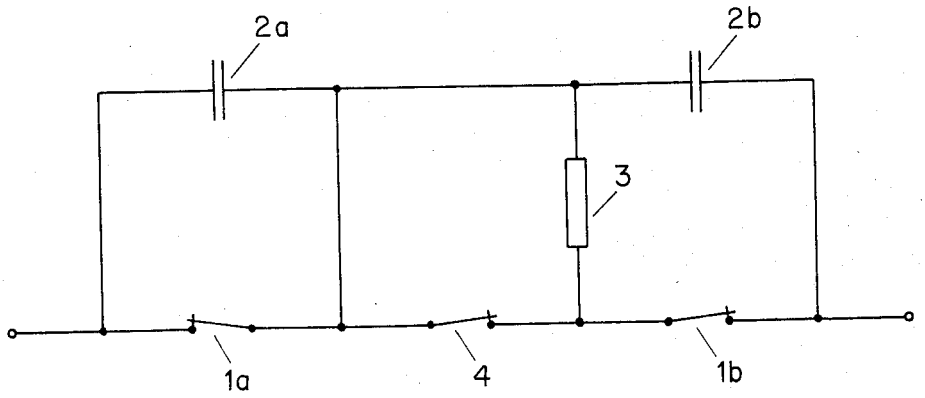
Figure 2B:
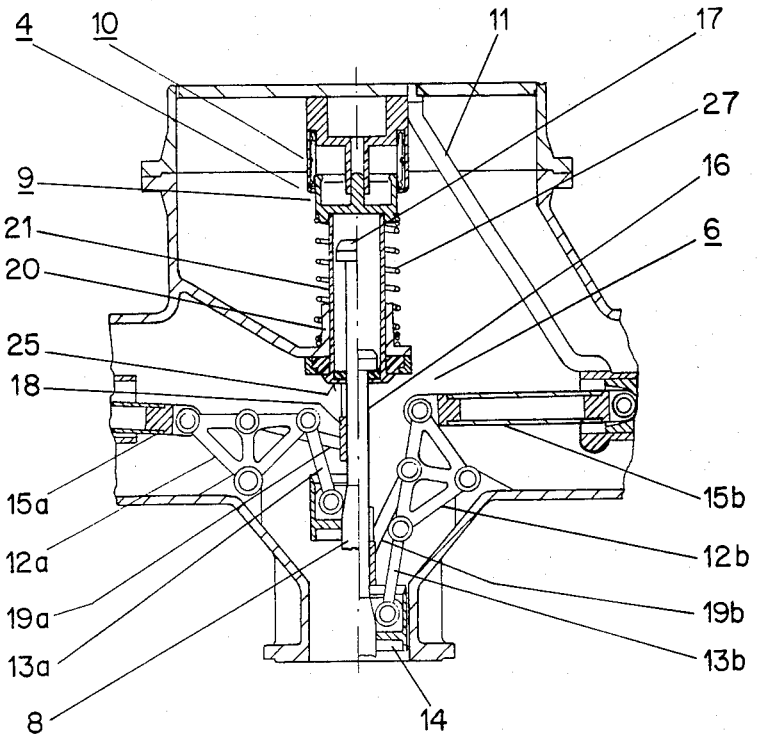
Figure 5:
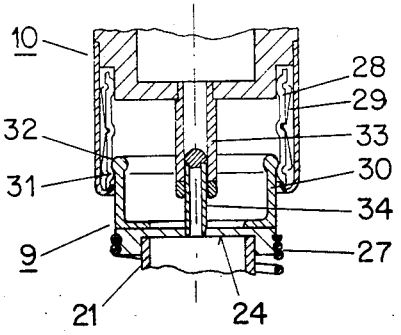
FIG. 5 shows, enlarged, a vertical section through the auxiliary switching point according to the first constructional design, in the on state.
Figure 3:
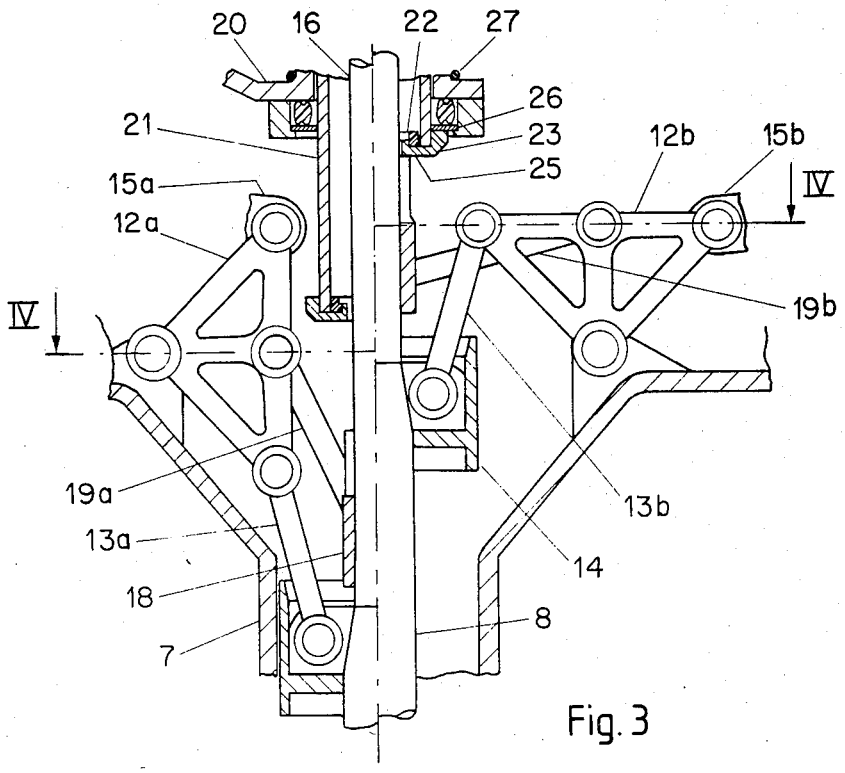
FIG. 3 shows, enlarged, a vertical section through the switching drive mechanism according to the first constructional design, on the left in the off state and on the right in the on state.
Figure 4:
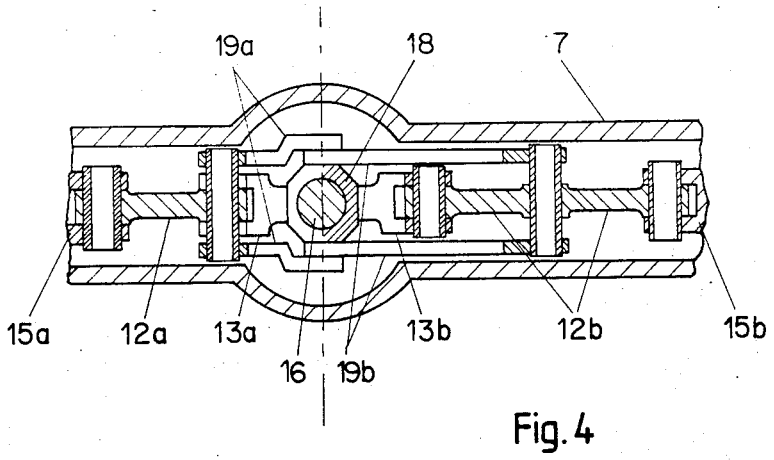
FIG. 4 shows, slightly diagrammatically, a section along IV—IV in FIG. 3.

During the further course of the switching-on movement, the hollow cylinder 21 is pushed up by the ramming piston 18 until the moving contact member 9 of the auxiliary switching unit 4 reaches its fixed contact member 10 at a time D, premature arcing being caught by the arcing contacts, and the moving rated-current contact 30 locks into the contact fingers 28 at a time E, reached shortly thereafter. With this action, the on state shown in the left-hand half of FIG. 2*b* is reached, at time D the switch has already assumed the electric state shown in FIG. 1*c*—the main switching points 1*a, b* and the auxiliary switching point 4 are closed, the current flows from the moving contact member of the first main switching point 1*a* via the housing 7 and essentially via the guide ring 20 and the hollow cylinder 21 to the auxiliary switching unit 4 and from the latter via the connecting conductor 11 to the moving contact member of the second main switching point 1*b.* The closing resistance 3 is short-circuited.

The time interval between the closing of the main switching points 1*a, b* at time C and the closing of the auxiliary switching unit 4 at time D is about 8 ms.

The construction, according to the invention, of the switching drive mechanism 6 including the ramming piston 18 pulled by the carrier bars 19*a, b* makes it possible that, during the switching-on process, the moving contact member 9 of the auxiliary switching unit 4 remains in the off position while the moving contact members of the main switching points 1*a, b* in each case pass through a first section of the path lying between their off position and their on position, and travels the total distance between its on position and its off position, while the moving contact members of the main switching points 1*a, b* in each case pass through the remaining section of the path lying between their on position and their off position, that is to say with a small residual stroke of the switching rod 8. The maximum distance between the contact members of the auxiliary switching unit 4 is thus maintained for a long time and premature arcing can start only shortly before the latter are closing.

The switching-off process is initiated during the beginning downward movement of operating rod 8, which causes the main switching points 1*a, b* to open, causing arcs that are drawn on the latter at time F. The ramming piston 18, which has no function during the switching-off process, and the plunger 17 also move downward, but the auxiliary switching unit 4 remains closed since the locking of the moving contact member 9 to its fixed contact member 10 withstands the force exerted by the tension spring 27.

At time G—the moving contact members of the main switching points 1*a, b* have moved further away from their fixed contact members and the plunger 17 has approached the withdrawing area 22. The arcs in the main switching points 1*a, b* become quenched and the switch changes over into the electric state shown in FIG. 1*d.* At this part the main switching points 1*a, b* are open, the auxiliary switching unit 4 is closed and the current is interrupted.

With the auxiliary switching unit 4 closed, the control capacitor 2*b* which, in conjunction with the control capacitor 2*a,* provides for uniform distribution of the voltage between the first main switching point 1*a* and the second main switching point 1*b,* is connected in parallel with the second main switching point 1*b* via the housing 7 and the auxiliary switching point.

At time H, the further downward movement of the switching rod 8 brings the back of the plunger 17 into contact with the withdrawing area 22. The switch is now in the state shown in the right-hand half of FIG. 2*b.* The force exerted by the plunger 17 releases the lock between the moving contact member 9 and the fixed contact member 10 of the auxiliary switching unit 4 which separate at time I. This causes the switch to return to the electric state shown in FIG. 1*a* i.e. all switching points are open.

Now the residual stroke of the switching rod 8 returns the moving contact members of the main switching points 1*a, b* and the plunger 17, and the tension spring 27 returns the moving switching member 9 of the auxiliary switching unit 4, into the off position shown in the left-hand half of FIG. 2*a.*

Figure 7:
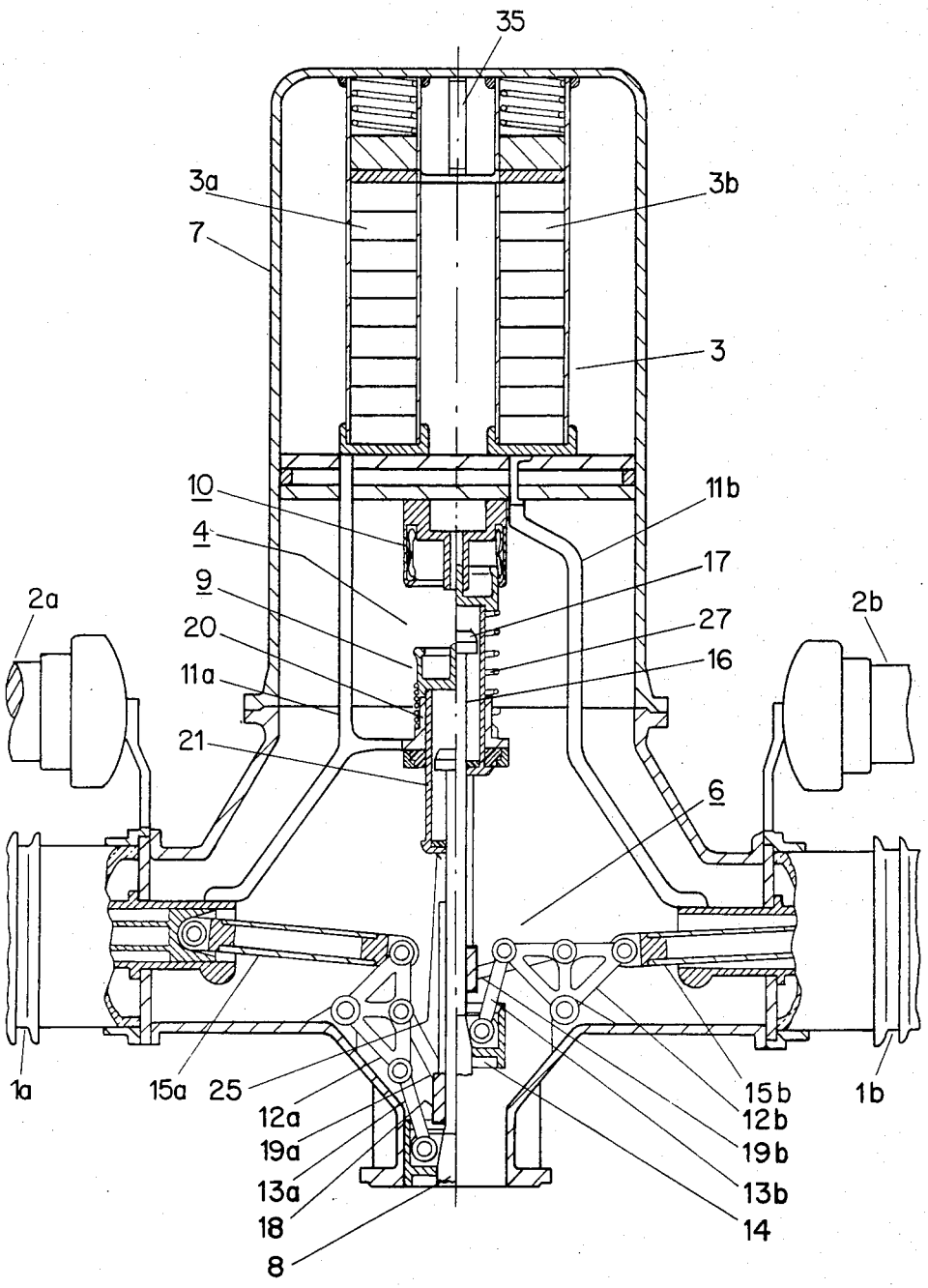
FIG. 7 shows a vertical section through the central housing comprising starting resistance, auxiliary switching point and switching drive mechanism of a switch according to the invention in accordance with a second constructional design, on the left in the off state and on the right in the on state.
Figure 8:
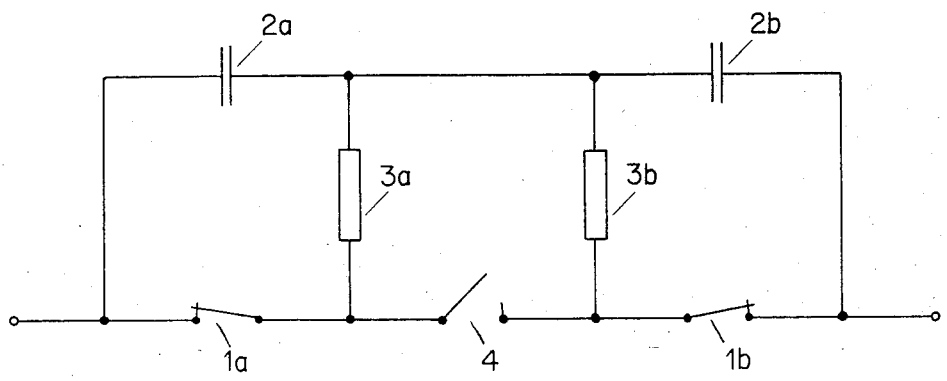

FIG. 7 shows a high-voltage switch according to the invention in accordance with a second embodiment, which completely corresponds in its construction and its mechanical operation to the high-voltage switch according to the first embodiment, described above, but differs from the latter by a slightly modified switching principle, shown in FIG. 8.

The closing resistance 3 is again divided into two columns which form two equally large series-connected resistance parts. A first resistance 3*a* and a second resistance 3*b*. The conductor piece connecting the two resistances 3*a, b* is also electrically conductively connected to the metal housing 7 via a connecting member 35.

The first main switching point 1*a* is connected to the closing resistance 3 and to the moving contact member 9 of the auxiliary switching unit 4 via a first connecting conductor 11*a* and the second main switching point is connected via a second connecting conductor 11*b* to the closing resistance 3 and the fixed contact member 10 of the auxiliary switching unit 4. Both main switching points 1*a, b* are not directly connected to housing 7. Actually, there are indirectly connected to the housing, via a respective one of the part resistances 3*a, b*. The guide rod 16 and the ramming piston 18 and both lifting tubes 15*a, b* are constructed of insulating material.

In operation, the switch according to the second embodiment of the invention virtually completely corresponds to the first embodiment. The difference is in that, when the switch is in the intermediate state, shown in FIG. 8 and occurring during the switching-on process, with closed main switching points 1*a, b* and open auxiliary switching unit 4, that is to say with the starting resistance 3 switched in, the potential of housing 7 is halfway between the two potentials present at the opposite ends of the closing resistance 3 since in each case one half of the voltage present at the closing resistance 3 develops across each of the two part resistances 3*a, b*. As a result, in contrast to the switch according to the first embodiment, the fixed contact member 10 of the auxiliary switching unit 4, the second main switching point 1*b* and the connecting conductor 11*b*, joining the two, need to be insulated with respect to the housing 7 only for a voltage equal to one half the switching voltage. Correspondingly, the insulation between the moving contact member 9, the first main switching point 1*a* and the connecting conductor 11*a* joining the two to each other and to the starting resistance 3, on the one hand, and the housing 7, on the other hand, also need to be designed only for half the switching voltage.

Figure 9A:
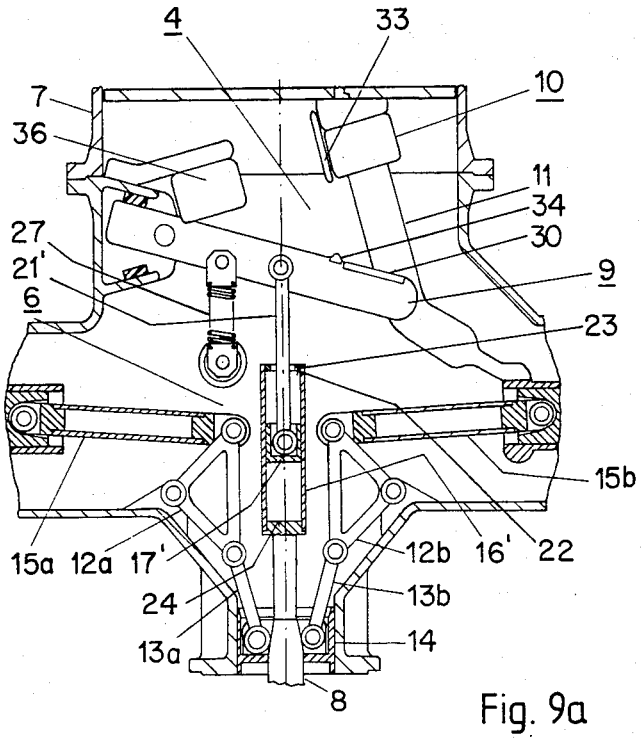
FIG. 9*a* shows the off state and FIG. 9*b* shows the on state.

FIGS. 9*a, b*, 10, 11 show a high-voltage switch according to a third embodiment of the present invention. With respect to its fundamental configuration and its electrical principle, as well as with respect to its mechanical principle, the third embodiment essentially corresponds to the high-voltage switch according to the first embodiment as explained above.

The guide part, which is rigidly joined to the operating rod 8 and in the continuation of the latter projects into the inside of the housing 7 which again consists of metal, has an end piece which is constructed as a guide cylinder 16, and the connecting part joining the moving contact member 9 of the auxiliary switching point 4 to the guide cylinder 16′ is constructed as connecting rod 21′ which is pivoted at one end on the moving contact member 9 and at the opposite end carries a pivoted stop piston 17′ which is carried in the guide cylinder 16′. The stop which limits the displaceability of the guide cylinder 16′ with respect to the connecting rod 21′ in the switching-off direction is formed by a withdrawing area 22, which faces the inside of the guide cylinder 16′, on a ring 23 which is attached to its on-side end and to the back of the stop piston 17′. On the off-side, the inside of the guide cylinder 16′ is delimited by a stop area 24.

The moving contact member 9 of the auxiliary switching unit 4 is constructed as a blade contact which is hinged at the housing 7. A tension spring 27, which is anchored with one end at the housing 7, is attached with its opposite end to the blade contact.

The fixed contact member 10 of the auxiliary switching unit 4 is provided with a fixed rated-current contact having contact fingers 28 which are arranged in two rows opposite to each other and which, in the on position, are pressed laterally by means of spring elements 29 against the moving rated-current contact 30 which is formed by a section of the on-side edge of the moving contact member 9. The contact fingers 28 are provided with cams 31 which, in conjunction with two lateral beads 32*a, b*, behind which they become engaged, at the moving rated-current contact 30 form a detent which, in the end position, is effective against the force of the tension spring 27 between the fixed contact member 10 and the moving contact member 9 of the auxiliary switching unit 4. A pincer-like fixed arcing contact 33 is arranged in continuation of the double row of contact fingers 28, which contact acts in conjunction with a fixed arcing contact 33 which is arranged in the continuation of the moving rated-current contact 30 at the moving contact member 9 and which is constructed as a cam attached to the on-side edge of the moving contact member 3. In the on position, a supplementary contact 36, which is also provided with a double row of contact fingers, provides for a good conductive connection between the housing 7 and the moving contact member 9 of the auxiliary switching unit 4.

Figure 10:
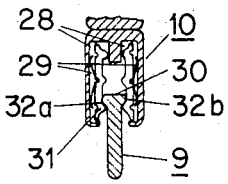
FIG. 10 shows, enlarged, a section along X—X in FIG. 9*b*.

Below the operation of the switch according to the third embodiment, which is essentially analogous to the operation of the switch according to the first embodiment, already explained, is briefly explained by referring FIGS. 1*a–d*, 9*a, b*, 10–12. In FIG. 10, time is again plotted on the abscissa, and the strokes of the moving contact members of the main switching points 1*a, b* (dot-dashed line) and of the moving contact member 9 of the auxiliary switching unit 4 (continuous line) are plotted on the ordinate. Designations 9*a*, 9*b* below the abscissa refer to FIGS. 9*a, b* and represent in each case the state of the switch reached at the given time. The brackets below the abscissa, becoming the designations 1*a–1d*, again designate the respective electric state of the switch, as represented in FIGS. 1*a–d*.

Figure 1B:
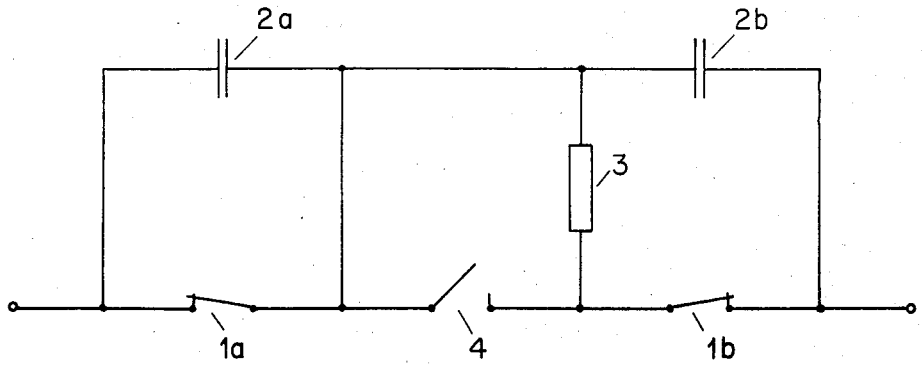
Figure 9B:
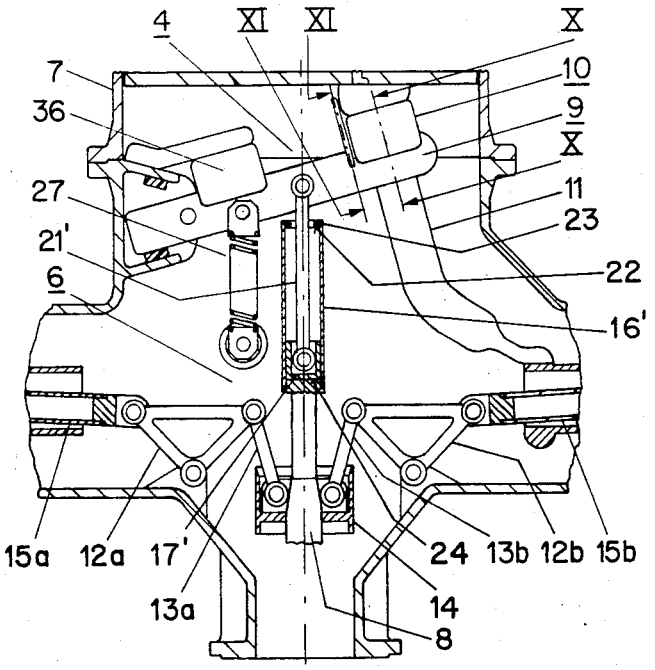
Figure 11:
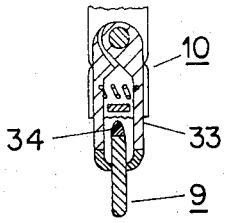
FIG. 11 shows, enlarged, a section along XI—XI in FIG. 9*b*.
Figure 12:
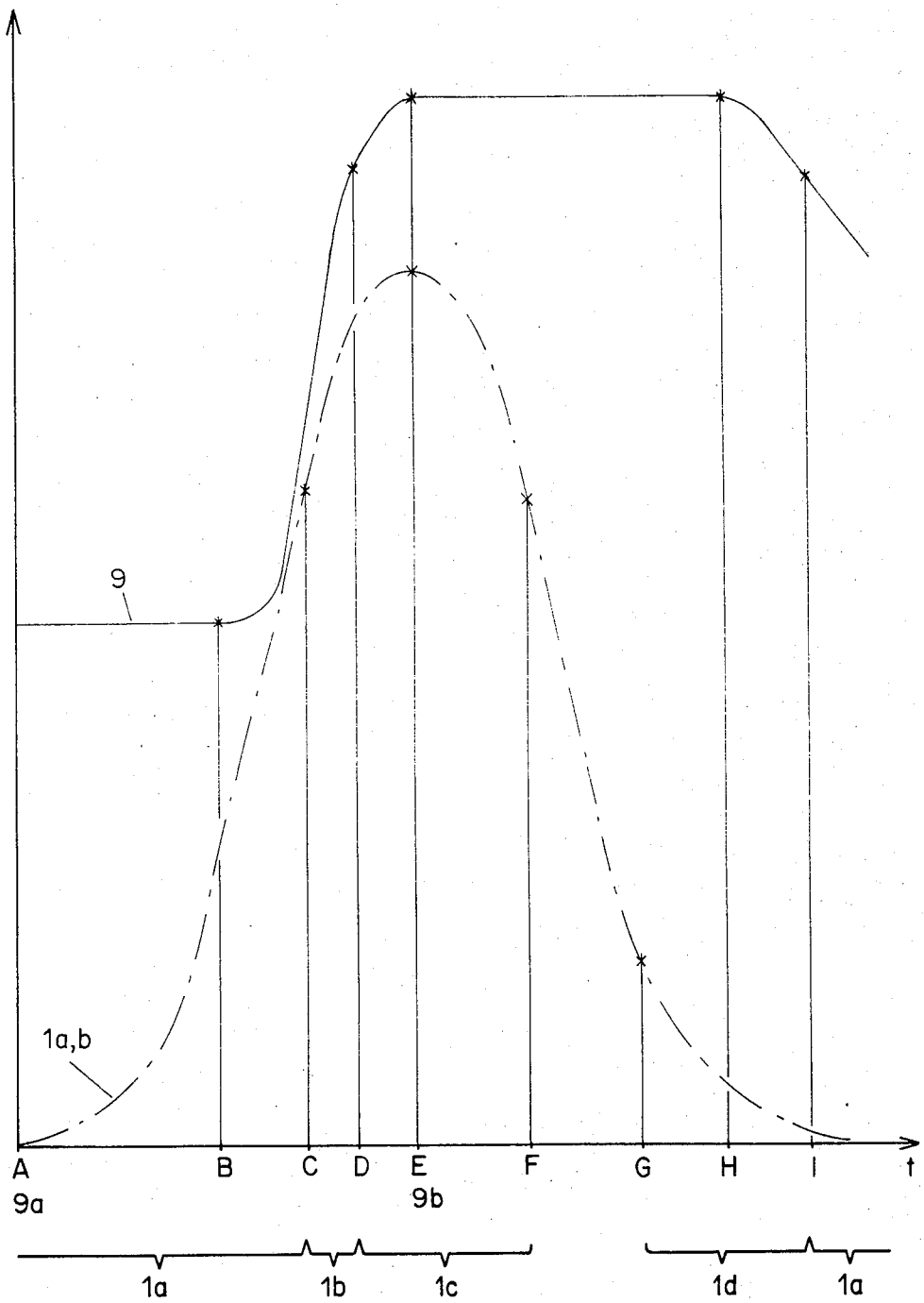
FIG. 12 shows, diagrammatically, the variation with time of the strokes of parts of the switch according to the invention in accordance with the third constructional design during a switching-on process and a switching-off process.

From the position in which it is located in the off state assumed at time A and shown in FIG. 9*a*, the operating rod 8 is moved upwards, the stop area 24 of the guide cylinder 16′ coming into contact with the stop piston 17′ at time B, and the main contact points 1*a, b* closing shortly thereafter at time C, which causes the switch to change from the electric state shown in FIG. 1*a* into the one shown in FIG. 1*b*. The upward movement, begun only at time B, of the moving contact member 9 of the auxiliary switching unit 4 leads to the two contact members coming into contact at time D, which causes the switch to assume the electric state according to FIG. 1*c*. Shortly thereafter, at time E, the moving rated-current contact 30 locks into the contact fingers 28 of the fixed rated-current contact of the auxiliary switching point 4, and the on state shown in FIG. 9*b* is reached.

Figure 1D:
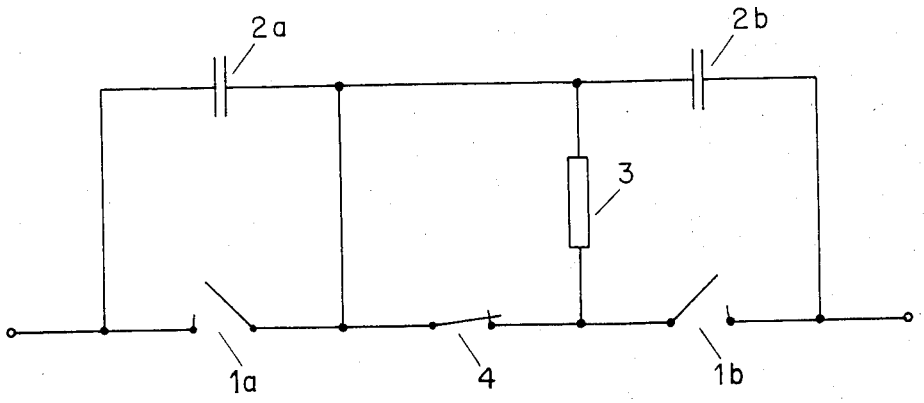

Downward movement of the operating rod 8 leads to the opening of the main switching points 1*a, b* at time F and furthermore to the quenching of the arcs drawn on these at time G, which causes the switch to reach the electric state of FIG. 1*d*. At time H, the withdrawing area 22 meets the back of the stop piston 17', as a result of which the locking between the moving contact member 9 and the fixed contact member 10 of the auxiliary switching unit 4 is released, which leads to the latter being separated at time I. The switch again reaches the electric state of FIG. 1*a*. The remaining stroke of the switching rod 8 brings the main switching points 1*a, b* and the guide cylinder 16', and the tension spring 27 brings the moving contact member 9 of the auxiliary switching unit 4, into the on state according to FIG. 9*a*.

Compared with the first and the second embodiment, the third embodiment has the advantage that the conversion of a small remaining stroke of the operating rod 8 into a relatively large switching movement of the moving contact member 9 can be easily effected, due to the fact that the latter is constructed as a blade contact, by appropriate selection of the hinging point of the latter at the housing 7 and of the distances between the housing and the hinging point of the connecting rod 16' at the blade contact, on the one hand, and between the latter and the moving arcing contact 34 and the moving rated-current contact 30, on the other hand. A ramming piston is not required.

In contrast, the first and the second embodiment make it possible to provide a more accurate guidance for the moving contact member 9. Due to its rotationally symmetrical design, the essential parts of the auxiliary switching unit 4 are produced more easily.

We claim:

1. A high-voltage circuit breaker, comprising:

a first main switching unit and a second main switching unit, each of the switching units comprising a respective contact arrangement which can be opened or closed;

at least one closing resistor connected in parallel to at least one auxiliary switching unit to form a parallel circuit, said at least one auxiliary switching unit comprising a respective contact arrangement which can assume an opened or closed position, said parallel circuit being disposed in series circuit relationship between said first and said second main switching units;

drive means including a drive and a switching drive mechanism that are so structured that said drive actuates, in common, said contact arrangements of said first and second main switching units and of said auxiliary switching unit; and means, comprised in said switching drive mechanism, for closing said respective contact arrangement of said at least one auxiliary switching unit in delayed relationship to the closing of said contact arrangement of said main switching units during a power turn-on procedure, and for opening said respective contact arrangement of said auxiliary switching unit in delayed relationship to the opening of said respective contact arrangement of said main switching units, during a power turn-off procedure.

2. High-voltage switch according to claim 1, in which the respective contact arrangement of the first and second main switching units comprise a movable contact and a stationary contact, the high-voltage switch further comprising a housing, said switching device mechanism being disposed in said housing and said first and second switching units being joined to said housing;

an operating rod coupled between said drive and said switching drive mechanism and first and second guide levers disposed oppositely to each other in relation to said operating rod, said first and second guide levers being pivotable in opposite rotational directions and being non-positively connected, on the one hand, to said operating rod and, on the other hand, to a respective one of said moving contacts of said first and second main switching units; and a guide part rigidly joined to said operating rod and projecting into and toward the interior of said housing and being effective for aiding the actuation of said at least one auxiliary switching unit.

3. High-voltage switch according to claim 2, characterised in that the moving contact (9) of the auxiliary switching member (4) is non-positively joined to a connecting part and that, to a limited extent, the connecting part and the guide part can be displaced with respect to each other in the direction of the switching movements.

4. High-voltage switch according to claim 3, further comprising a tension spring so disposed that, in an on position, the moving contact (9) of the auxiliary switching unit (4) is stressed by the tension spring (27), which is so anchored as to supply a force acting in an off direction means for locking the moving contact of the auxiliary switching unit in such a manner that the locking withstands the force exerted by the tension spring (27) but can be released by a force exerted, during a switching-off process, by the guide part in the off direction, the switch further comprising a stop which limits the displaceability of the guide part with respect to the connecting part in the off direction, said stop being reached by the guide part during the course of its switching-off movement.

5. High-voltage switch according to any one of claims 2, 3 or 4, in which the housing (7) is comprised of metal and the moving contact of the first main switching unit (1*a*) and a switching member of the auxiliary switching unit (4) are electrically conductively connected to the housing, characterized in that the at least one closing resistance (3) and the auxiliary switching unit (4) are arranged in the housing (7), the electrically conductive connection between the first main switching unit (1*a*) and the closing resistance (3) being established via the housing and the second main switching unit (1*b*) is not directly electrically connected to the housing.

6. High-voltage switch according to any one of claims 2, 3 or 4, in which the housing (7) is comprised of metal, characterized in that the at least one closing resistance (3) and the auxiliary switching unit (4) are arranged in the housing (7), in that, at the closing resistance (3), a connection is provided which is electrically connected to the housing (7) and which divides the closing resistance into a first part resistance (3*a*) and a second part resistance (3*b*), and in that the main switching units (1*a*,1*b*) are not directly electrically conductively connected to the housing (7).

7. High-voltage switch according to claim 3, characterized in that the guide part is constructed as a guide rod (16) having at its end a plunger (17) and the connecting part is constructed as a hollow cylinder (21) which is inverted over the guide rod (16) and which at its end facing the fixed contact member (10) of the auxiliary switching unit (4) carries the moving contact (9) of the auxiliary switching unit, the stop which limits the displaceability of the guide rod (16) with respect to the hollow cylinder (21) in the switching-off direction is formed by the back of the plunger (17) and a withdrawing area (22), which faces the inside of the hollow cylinder (21), on a ring (23) which is attached to its end turned away from the fixed contact (10) of the auxiliary switching unit (4), the hollow cylinder (21) is carried in a guide ring (20) which is rigidly joined to the housing (7), the tension spring (27) coaxially surrounds the hollow cylinder (21) and is anchored at the guide ring (20), the contact fingers (28) of the fixed contact (10) of the auxiliary switching unit (4), in a crown-like arrangement, coaxially at a distance surround a fixed arcing contact (33) which is centrally arranged, the moving contact (9) of the auxiliary switching unit (4) containing an annular moving rated-current contact (30) which, in the on position, is contacted by the contact fingers (28) and which coaxially at a distance surrounds a moving arcing contact (34) which is centrally arranged.

8. High-voltage switch according to claim 7, characterised in that the switching drive mechanism (6) is provided with a ramming piston (18) which is non-positively joined to at least one guide lever (12*a*, 12*b*) by means of a carrier bar (19*a*, 19*b*) which, in the off position, assumes an acute angle with respect to the guide rod (16), its pivoting point at the ramming piston (18) being located on the off side of its pivoting point at the guide lever (12*a*, 12*b*), and, in the on position, assumes approximately a right angle to the guide rod (16), in such a manner, that, during the switching-on movement, the ramming piston strikes a ramming area (25) on the outside of the ring (23) which is attached to the end of the hollow cylinder (21) and pushes the hollow cylinder (21) into the on position.

9. High-voltage switch according to claim 3, characterized in that the guide part is provided with an end piece which is constructed as a hollow guide cylinder (16′) and the connecting part is constructed as a connecting rod (21′) which is hinged with its end facing the fixed contact (10) of the auxiliary switching unit (4) at its moving contact (9) and carries at the opposite end a pivoted stop piston (17′) which is carried in the guide cylinder (16′), the stop piston, which limits the displaceability of the guide rod (16′) with respect to the connecting rod (21′) in the switching-off direction, being formed by a withdrawing area (22), which faces the inside of the guide cylinder (16′), at a ring (23) which is attached to its end facing the fixed contact (10) of the auxiliary switching unit (4) and to the back of the stop piston (17′), contact fingers (28) on the fixed contact (10) are arranged in two rows which are opposite to each other and in the continuation of which a pincer-like fixed arcing contact (33) is arranged, the moving contact (9) of the auxiliary switching unit (4) being constructed as a blade contact which is pivoted at one end on the housing (7) and which, in the switching-on position, is contacted on both sides by the contact fingers (28), provided with a moving arcing contact (34) which is constructed as a cam which is attached to the edge, facing the fixed contact member (10) of the auxiliary switching unit (4), of the moving contact (9).

* * * * *